US006042217A

United States Patent [19]

Jones

[11] Patent Number: 6,042,217

[45] Date of Patent: Mar. 28, 2000

[54] PRINT HEAD POSITIONER MECHANISM

[75] Inventor: Michael E. Jones, Portland, Oreg.

[73] Assignee: Tektronic, Inc., Wilsonville, Oreg.

[21] Appl. No.: 08/900,496

[22] Filed: Jul. 25, 1997

[51] Int. Cl.[7] ..... B41J 2/165

[52] U.S. Cl. ..... 347/32; 347/8; 347/20

[58] Field of Search ..... 347/32, 8, 19, 347/20, 103, 198; 400/55–59

[56] References Cited

U.S. PATENT DOCUMENTS

| | | | |
|---|---|---|---|
| 4,538,156 | 8/1985 | Durkee et al. | 346/21 |
| 4,843,338 | 6/1989 | Rasmussen et al. | 347/8 |
| 4,952,084 | 8/1990 | Maruyama | 400/120 |
| 4,990,004 | 2/1991 | Kawahara et al. | 400/56 |
| 5,115,250 | 5/1992 | Harmon et al. | 347/33 |
| 5,156,464 | 10/1992 | Sakai | 400/56 |
| 5,227,809 | 7/1993 | Carpenter et al. | 400/56 |
| 5,608,430 | 3/1997 | Jones et al. | 347/8 |

*Primary Examiner*—N. Le
*Assistant Examiner*—Shih-wen Hsieh
*Attorney, Agent, or Firm*—Charles F. Moore

[57] ABSTRACT

A print head positioner includes a tilt mechanism that selectively engages and moves a carriage supporting the print head when the print head and supporting carriage are in a home position. The print head positioner is uncoupled from the carriage X-axis drive mechanism during imaging to avoid extraneous loading on the mechanism. The positioner includes interlocks to prevent inadvertent disengagement from the carriage during tilting and to restrict print head tilting when the carriage is away from the home position.

14 Claims, 5 Drawing Sheets

PRINT HEAD POSITIONER MECHANISM

TECHNICAL FIELD

The present invention relates generally to ink jet printers and, more particularly, to a print head positioner that selectively engages a carriage supporting an ink jet print head and pivots the carriage and print head relative to an image-receiving medium.

BACKGROUND OF THE INVENTION

Ink-jet printing systems commonly utilize either direct printing or offset printing architecture. In a typical direct printing system, ink is ejected from jets in the print head directly onto the final receiving medium. In an offset printing system, the print head jets the ink onto an intermediate transfer surface, such as a liquid layer on a drum. The final receiving medium is then brought into contact with the intermediate transfer surface and the ink image is transferred and fused or fixed to the medium.

In some direct and offset printing systems, the print head moves relative to the final receiving medium or the intermediate transfer surface in two dimensions as the print head jets are fired. Typically, the print head is translated along an X-axis while the final receiving medium/intermediate transfer surface is moved along a Y-axis. In this manner, the print head "scans" over the print medium and forms a dot-matrix image by selectively depositing ink drops at specific locations on the medium.

As the size of the desired image increases, the X-axis movement/head translation and/or Y-axis motion requirements become greater. One technique for printing larger-format images is disclosed in co-pending application Ser. No. 08/757,366 for IMAGE DEPOSITION METHOD, assigned to the assignee of the present application. This application discloses a method for interleaving or stitching together multiple image portions to form a larger composite image. Each of the image portions is deposited with a separate X-axis translation of the print head. After the deposition of each image portion, the print head is moved without firing the jets to the start position for the next image portion. Adjacent image portions overlap and are interleaved at a seam to form the composite image.

In this image deposition method, the relative position of each image portion must be carefully controlled to avoid visible artifacts at the seam joining adjacent image portions. With specific regard to the X-axis movement of the print head, it is necessary to precisely deposit each image portion such that adjacent image portions are aligned to properly interleave at the seam. It is also periodically necessary to move or tilt the print head away from the image-receiving drum to provide clearance for head maintenance operations such as purging, wiping and flushing, to thermally isolate the print head from the drum during non-printing periods and to provide a configuration that is resistant to shipping damage.

Prior art print head positioners have utilized various mechanisms to move a print head away from an image-receiving medium. An exemplary patent directed to a print head positioning apparatus is U.S. Pat. No. 5,608,430 for PRINTER PRINT HEAD POSITIONING APPARATUS AND METHOD (the '430 patent), assigned to the assignee of the present application. This patent discloses a print head tilt angle positioner that utilizes a tilt arm and a print head that are affixed to a shaft. The tilt arm rotates the shaft to move the attached print head away from the image receiving drum. To translate the print head laterally in the X-axis direction parallel to the drum, the entire shaft and attached tilt angle positioner mechanism are moved laterally. As the print head disclosed in the '430 patent is substantially the same width as the widest image to be printed, the shaft and attached print head and tilt angle positioner mechanism are required to translate only approximately 10 mm.

While the tilt angle positioner of the '430 patent provides highly accurate and repeatable positioning of a print head, it is less desirable for printers that require greater head translation distances for printing larger-format images. The rigid coupling of the tilt angle positioner to the shaft and attached print head creates a parasitic load on the lateral X-axis drive system that could potentially create undesirable image artifacts, especially as the print head translation distances along the X-axis increase.

The present invention is directed to a print head positioner that is uncoupled from the X-axis drive mechanism during imaging. The print head positioner includes a print head tilt mechanism that selectively engages a carriage supporting the print head and moves the carriage and print head only when the carriage is in a home position. The print head positioner also includes interlocks to prevent inadvertent disengagement from the carriage during tilting and to limit tilting when the carriage is not in the home position.

SUMMARY OF THE INVENTION

It is an aspect of the present invention to provide a print head positioner for accurately, repeatably and reliably positioning a print head assembly relative to an image receiving medium.

It is another aspect of the present invention to provide a print head positioner for positioning a print head relative to an image receiving medium such that high-resolution printing is achieved in larger-format printing apparatus that require significant movement of the print head to create the desired image.

It is a feature of the present invention that the print head positioner provides print head to image receiving medium spacings suitable for printing, print head maintenance and shipping purposes.

It is another feature of the present invention that the print head positioner is uncoupled from the print head X-axis drive mechanism during imaging to avoid parasitic loading of the mechanism.

It is an advantage of the present invention that the print head positioner engages and tilts the carriage supporting the print head only when movement away from the image receiving drum is required.

It is another advantage of the present invention that the print head positioner includes interlocks to prevent disengagement from the carriage during tilting and to limit tilting when the carriage is not in a home position.

To achieve the foregoing and other aspects, features and advantages, and in accordance with the purposes of the present invention as described herein, an improved print head positioner is provided. The print head positioner includes a print head tilt mechanism that comprises a tilt arm having a fork at a first end and a cam follower at a second end. When the carriage supporting the print head is positioned at a home position, the fork of the tilt arm captures a pin extending from the carriage. The cam follower of the tilt arm is moved by a cam to pivot the tilt arm and move the carriage and print head away from the image receiving drum. When the carriage is tilted at least a predetermined distance, an interlock prevents the carriage from translating away from the fork and possibly disengaging the pin from the fork and allowing the print head to spring forward towards the drum.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

DETAILED DESCRIPTION OF THE PREFERRED EMBODIMENT

Figure 1:
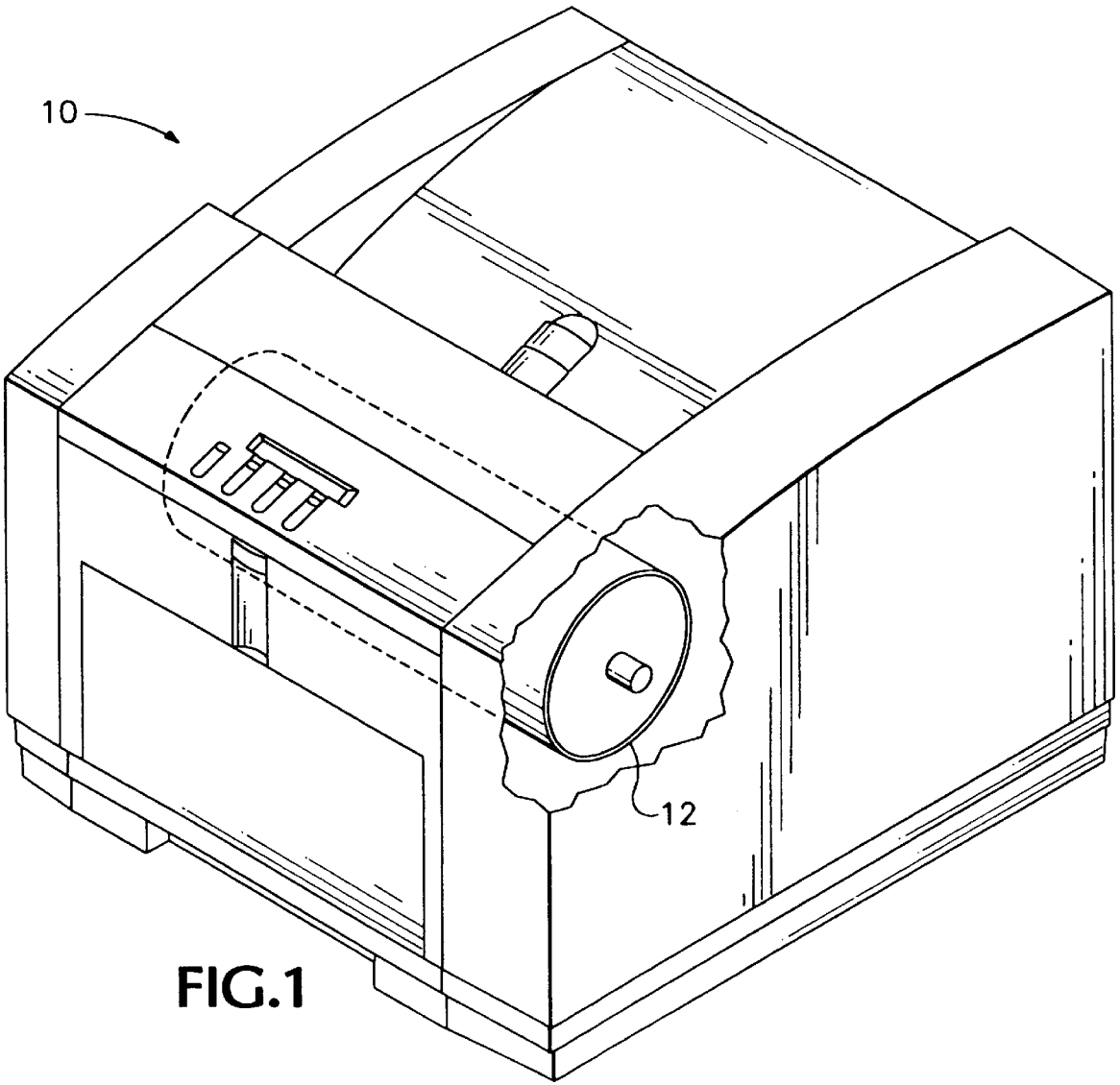
FIG. 1 is an overall perspective view of a solid ink-jet transfer color printer that utilizes the print head positioner of the present invention, the printer being shown with a portion broken away to reveal the image receiving medium or drum inside.

FIG. 1 shows an overall view of a solid ink-jet color printing apparatus, generally represented by the reference numeral 10, that utilizes a transfer or offset printing process and incorporates the print head positioner of the present invention. An example of a transfer printing process is disclosed in U.S. Pat. No. 5,389,958 (the '958 patent) entitled IMAGING PROCESS and assigned to the assignee of the present application. The '958 patent is hereby specifically incorporated by reference in pertinent part. The following description of a preferred embodiment of the present invention refers to its use in this type of printing apparatus. It will be appreciated, however, that the print head positioner of the present invention may be used with other ink-jet printing apparatus that utilize different architectures, such as direct printing apparatus in which ink is jetted directly onto a receiving medium, and with various other printing, imaging and/or copying apparatus and systems. Accordingly, the following description will be regarded as merely illustrative of one embodiment of the present invention.

Figures 2, 3:
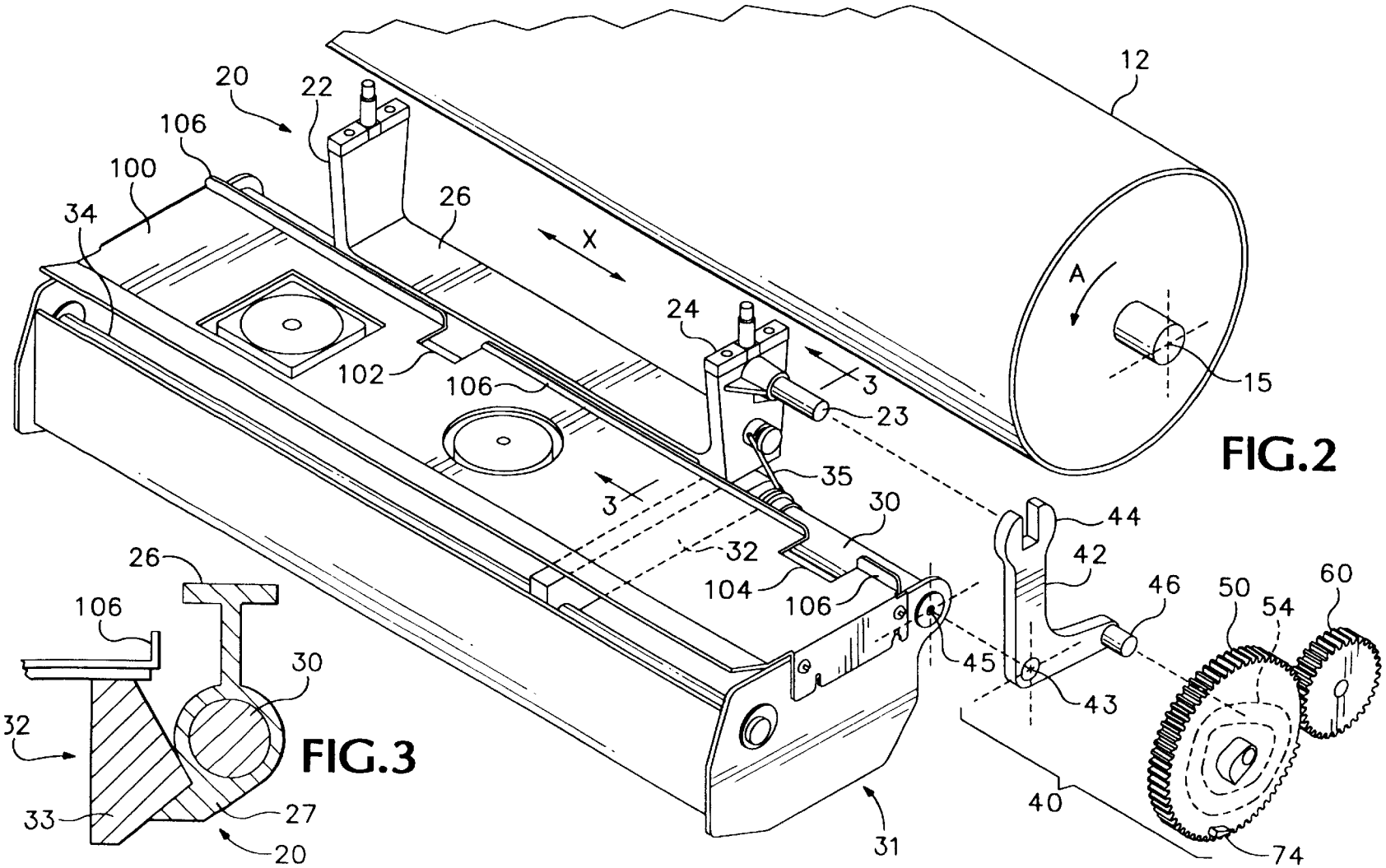
FIG. 2 is a partially exploded perspective diagram of the print head positioner illustrating the tilt arm, gear-driven cam and process gear and showing the carriage being positioned along the X-axis away from the home position.
FIG. 3 is a partial side elevational view taken along the lines 3—3 of FIG. 2 showing a stop in the carriage that limits the pivoting travel of the carriage.

With reference to FIGS. 1 and 2, the printing apparatus 10 includes an image receiving medium in the form of a transfer drum 12 that rotates in the direction of action arrow A. Prior to printing, an intermediate transfer surface (not shown) is applied to the drum 12. A print head 14, partially shown in FIG. 4 and preferably having an array of ink-jet nozzles (not shown), is spaced apart from the drum 12 and ejects liquid ink onto the intermediate transfer surface to form an ink image thereon. Suitable liquids that may be employed for the intermediate transfer surface include water, fluorinated oils, glycol, surfactants, mineral oil, silicon oil, functional oils, or combinations thereof, Functional oils can include, but are not limited to, mercapto-silicone oils, fluorinated silicone oils, and the like. The image receiving surface to which the intermediate transfer surface is applied may be formed from or surface coated with any appropriate material, such as metals including but not limited to aluminum, nickel, or iron phosphate, elastomers including but not limited to fluoroelastomers, perfluoroelastomers, silicone rubber, and polybutadiene, plastics including but not limited to polyphenylene sulfide loaded with polytetrafluorethylene, thermoplastics such as polyethylene, nylon, and FEP, thermosets such as acetals, and ceramics. The preferred material is anodized aluminum. The image receiving medium may take the form of a drum 12 as shown, or alternatively may be a belt, web, platen, or other suitable design.

Figure 4:
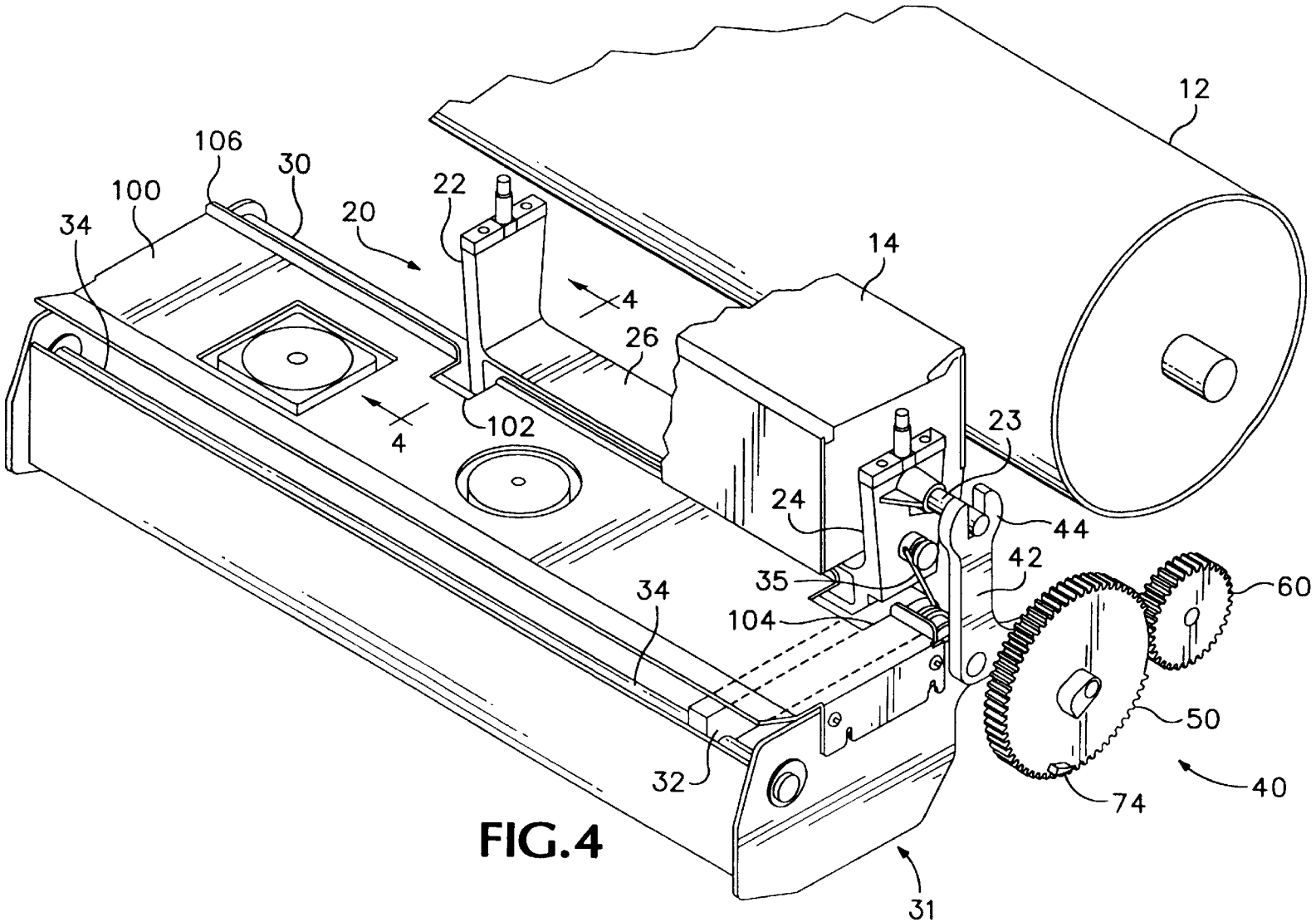
FIG. 4 is a perspective diagram showing the carriage and a cut-away portion of the print head in the home position with the fork of the tilt arm capturing the pin of the carrage.

With reference now to FIGS. 2 and 4, in operation the print head 14 is moved parallel to the transfer drum 12 along an X-axis as the drum 12 is rotated and the print head jets (not shown) are fired. In this manner, an ink image is deposited on the intermediate transfer surface that is supported by the outer surface of the drum 12. When the image is fully deposited on the intermediate transfer surface, a final receiving medium, such as a sheet of paper or a transparency, is brought into contact with the transfer drum 12, and the deposited image is simultaneously transferred and fixed (transfixed) to the medium.

Figure 5:
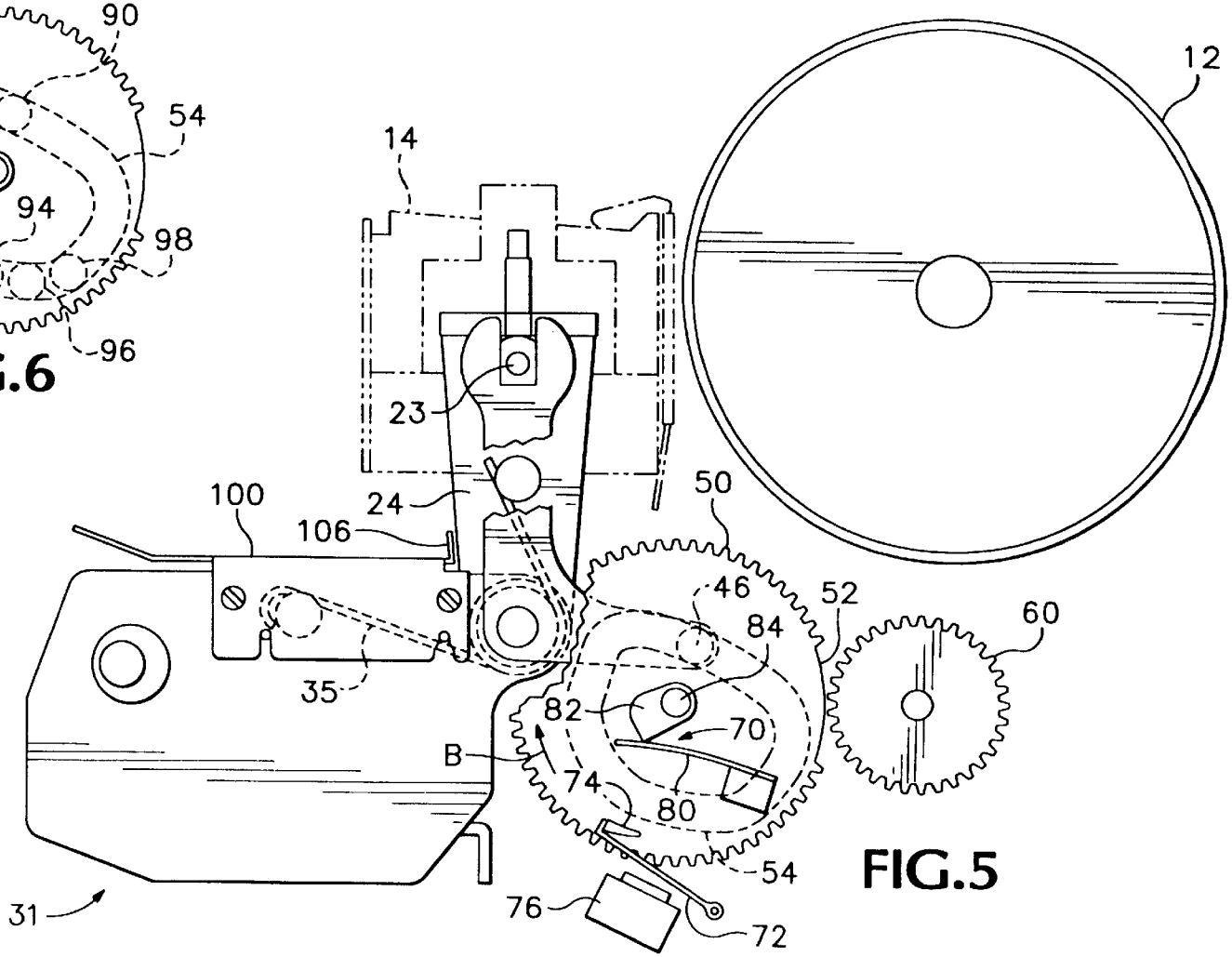
FIG. 5 is a side elevational view showing the print head tilt mechanism, carriage and print head in a printing position relative to the drum.

As best seen in FIGS. 4 and 5, the print head 14 is mounted on a carriage, generally designated by the reference numeral 20. The carriage 20 includes opposing first and second flanges 22, 24, respectively, that extend upwardly from a base 26. With reference now to FIG. 2, the carriage 20 is slidably and rotatably mounted on a front guide shaft 30 that extends parallel to the drum 12 and is supported by a mounting chassis 31. A stabilizing arm 32 slidably connects the carriage 20 to a rear guide shaft 34 that is parallel to the front guide shaft 30.

The carriage 20 and attached print head 14 are slidingly translated along the front and rear guide shafts 30, 34 parallel to the axis of rotation 15 of the drum 12 in the directions of action arrow X by an X-axis drive mechanism (not shown). An example of a suitable X-axis drive mechanism is disclosed in copending application Ser. No. 08/757,366 for IMAGE DEPOSITION METHOD, which application is specifically incorporated by reference in pertinent part. It will be appreciated by those skilled in the art that various other mechanisms for translating the carriage 20 and print head 14 in the X-axis direction may be utilized with the present invention.

Referring now to FIGS. 2, 4 and 5, the components and operation of the print head positioner of the present invention will now be described. A print head tilt mechanism, generally indicated by the reference numeral 40, includes a tilt arm 42, a gear-driven cam 50, and a process gear 60, each being rotatably mounted within the printing apparatus 10. The gear-driven cam 50 includes a missing-tooth portion 52 and a scroll cam 54, best seen in FIG. 5. The gear-driven cam 50 is biased to rotate in a clockwise direction as indicated by action arrow B by a biasing mechanism 70 described in more detail below. The missing-tooth portion 52 of the gear-driven cam 50 is held in the printing (disengaged) position shown in FIGS. 4 and 5 by a latch arm 72 abutting a tab 74 on the periphery of the gear-driven cam 50.

The gear-driven cam 50 is actuated by energizing a solenoid 76 that pivots the latch arm 72 away from the tab 74, thereby causing the toothed gear portion of the gear-driven cam 50 to rotate into engagement with process gear 60, which receives rotational power from a drive motor (not shown). The process gear 60 subsequently controls the rotation of the gear-driven cam 50.

With continued reference to FIG. 5, the biasing mechanism 70 generates rotational bias in the direction of action arrow B by urging a leaf spring 80 against a cam 82 that is positioned on a hub 84 of the gear-driven cam 50. The cam 82 is positioned on hub 84 such that the leaf spring 80 and cam 82 apply rotational bias in the direction of action arrow B to the gear-driven cam 50 when it is in the printing position. Rotational bias is necessary to engage and disengage the process gear 60 with the toothed gear portion of the gear-driven cam 50 when the latch arm 72 is disengaged from the tab 74.

With reference to FIGS. 2 and 4, the tilt arm 42 is substantially L-shaped and includes a fork 44 at a first end and a cam follower 46 at a second end. The follower 46 rides inside the scroll cam 54 within the gear-driven cam 50. When the gear-driven cam 50 rotates, the scroll cam 54 guides the follower 46 to provide controlled rotational motion to the tilt arm 42 about a tilt axis of rotation 43. As shown in FIG. 2, the tilt axis of rotation 43 is coaxial with the carriage/print head axis of rotation 45 about the shaft 30.

With reference now to FIG. 4, the carriage 20 and print head 14 are shown in a home position along the X-axis. In the home position, a pin 23 extending laterally from the second flange 24 of the carriage 20 is captured by the fork 44, thereby allowing the tilt arm 42 to tilt the carriage and print head 14 away from the drum 12. It will be appreciated by viewing FIG. 5 that the tilt arm 42 and fork 44 are not engaged or in contact with the pin 23 when the carriage 20 and print head 14 are in a printing position of 0 degrees tilt relative to the drum 12. Advantageously, this ensures that the print head tilt mechanism 40 does not exert a parasitic load on the X-axis drive mechanism during imaging which could potentially create undesirable image artifacts.

Figure 6:
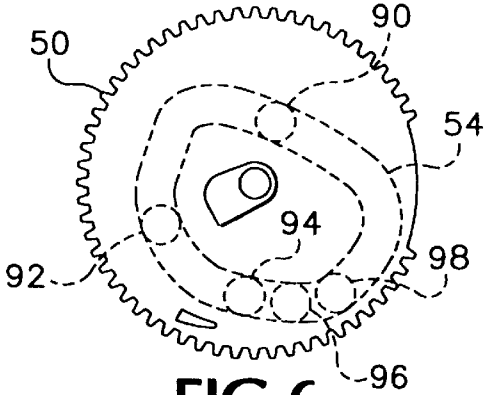
FIG. 6 is an isolated diagrammatical view of the gear-driven cam showing in phantom five positions of the cam follower within the scroll cam, the positions corresponding to printing, print head maintenance and standby positions.
Figure 7:
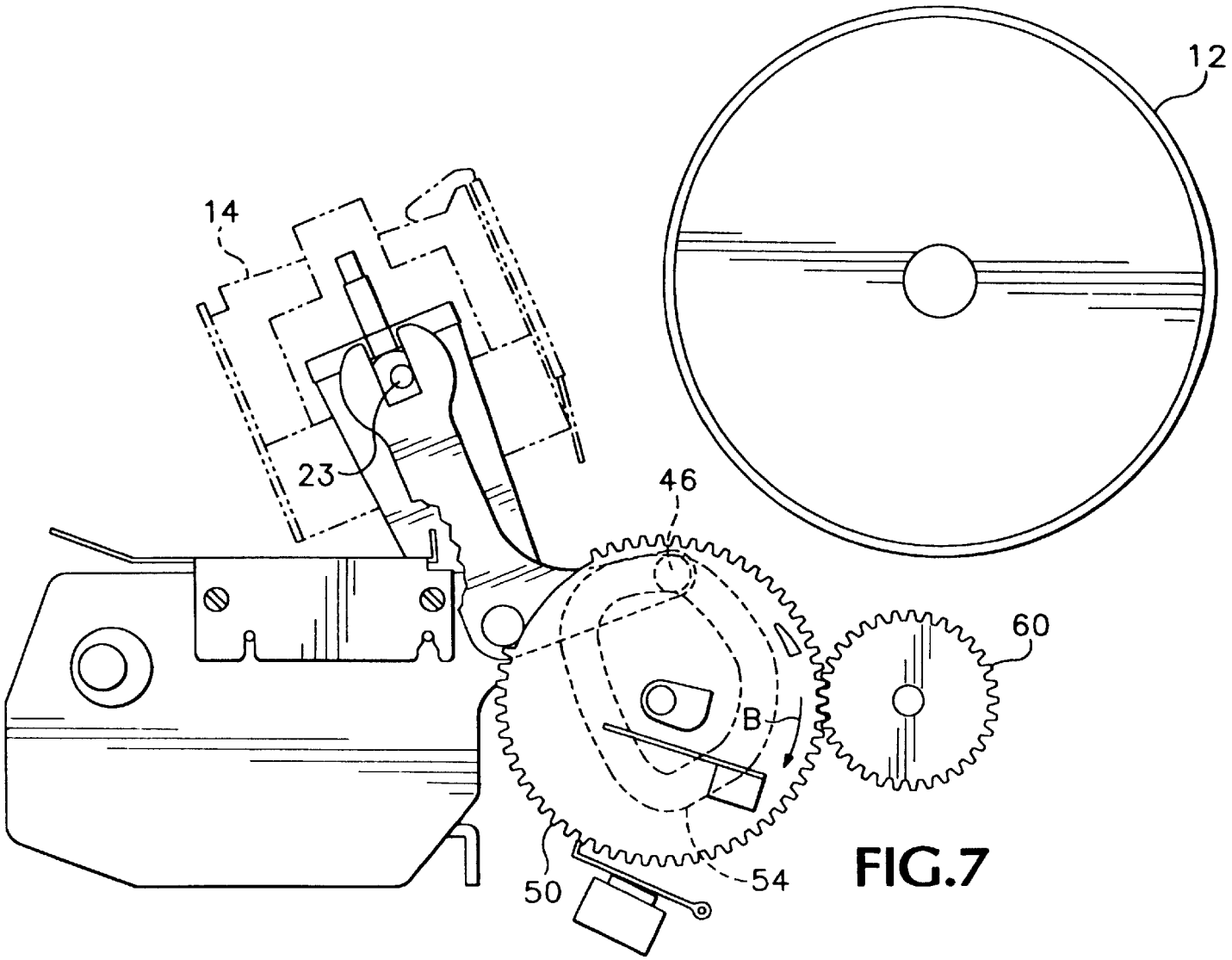
FIG. 7 is a side elevational view showing the print head tilt mechanism, carriage and print head in a maximum tilt position.

As shown in FIGS. 2, 3 and 5, a coil spring 35 on the shaft 30 biases a stop 27 on base 26 of the carriage 20 against an angled face 33 on the stablizing arm 32. This establishes the printing position of zero degrees relative to the drum. When the carriage 20 is moved along the X-axis to the home position (FIG. 4) and the pin 23 is captured by the fork 44, the tilt arm 42 may be pivoted to rotate the carriage 20 and print head 14 about the shaft 30 between printing and maintenance tilt angle positions. With reference now to FIGS. 5–7, in the preferred embodiment of the present invention, rotation of the gear-driven cam 50 in the direction of action arrow B tilts the carriage 20 and print head 14 from the printing position of 0 degrees (FIG. 5) to a maximum tilt position of approximately 25 degrees (FIG. 7) away from the drum 12. As the print head 14 is tilted back, it passes through eight functional positions, with five of the positions corresponding to dwells of the cam follower 46 that facilitate accurate positioning. FIG. 6 illustrates in phantom these five positions of the cam follower within the scroll cam 54: a first position 90 of the follower 46 corresponds to a printing position (also shown in FIG. 5) at 0 degrees tilt; a second position 92 corresponds to a head maintenance position used for purging the print head 14 at approximately 15 degrees tilt; a third position 94 corresponds to a head maintenance position used to wipe the print head 14 after purging at approximately 17.5 degrees tilt; a fourth position 96 corresponds to a restraint position at approximately 24.5 degrees used to remove the load of the coil spring 35 from the gear-driven cam 50 after power-down; and a fifth position 98 corresponds to a maximum tilt of approximately 25 degrees (see FIG. 7) used for maximum thermal isolation between the print head and the drum 12. From this fifth position 98 of maximum tilt, the printing position 90 is found by rotating the gear-driven cam 50 in the direction of action arrow B until the missing tooth portion 52 uncouples the gear-driven cam 50 from the process gear 60. The gear-driven cam 50 will continue to rotate under the torque of leaf spring 80 until stopped by the tab 74 and latch arm 72.

With reference now to FIGS. 2 and 4, and in an important aspect of the present invention, the print head positioner includes an interlock to prevent inadvertent disengagement of the pin 23 from the fork 44 during print head tilting. In the preferred embodiment, the interlock comprises a cover plate 100 that includes first and second spaced apart slots 102, 104. The cover plate 100 is affixed to the mounting chassis 31 and extends in a plane parallel to the front guide shaft 30. As shown in FIG. 4, the first and second slots 102, 104 are aligned with the first and second flanges 22, 24 of the carriage 20 when the carriage is in the home position along the X-axis. As best appreciated by viewing FIGS. 4 and 7, at 5 degrees of tilt and greater the first and second flanges 22, 24 pass into the slots 102, 104. In this manner, the edges of the slots 102, 104 limit the travel of the carriage 20 in the X-axis direction so that the pin 23 cannot disengage from the fork 44. Advantageously, this interlock prevents the pin 23 from escaping the tilt arm 42 and allowing the print head 14 to freely spring forward and possibly contact the drum 12 and damage the print head.

In another important aspect of the present invention best seen in FIGS. 2 and 5, the cover plate 100 includes upwardly extending lips 106 that limit carriage tilt at all X-axis positions where the carriage pin 23 is not captured by the fork 44. The lips 106 of the cover plate 100 prevent tilting of the carriage 20 when the carriage is not in the home position, thereby reducing the risk of the carriage being titled away from the drum 12 and released such that the print head 14 springs forward into the drum 12.

The foregoing description of a preferred embodiment of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different printing apparatus, all without departing from the inventive concepts disclosed herein.

The preferred embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally, and equitably entitled. All patents cited herein are incorporated by reference in their entirety.

What is claimed is:

1. In a printing apparatus having a print head and an image-receiving medium that move in respective first and second directions and in which the print head is spaced apart a desired distance from the image-receiving medium in a third direction, a print head positioner comprising in combination:

a carriage supporting the print head;

a shaft to which the carriage is slidably and rotatably coupled, the shaft being supported by a mounting chassis; and a print head tilt mechanism including a tilt arm that selectively engages the carriage and rotates the carriage about the shaft to position the print head in the third direction at respective printing and maintenance positions relative to the image-receiving medium.

2. The print head positioner of claim 1, wherein the tilt arm includes a fork and the carriage includes a pin that is captured by the fork when the carriage is positioned at a home position in the first direction.

3. The print head positioner of claim 2, wherein the tilt arm includes a cam follower that is spaced apart from the fork, the follower being movable by a cam such that angular positions of the cam impart corresponding angular positions to the tilt arm.

4. The print head positioner of claim 3, wherein the cam imparts a particular angular position to the tilt arm that positions the print head in the maintenance position.

5. The print head positioner of claim 4, further including a biasing spring that urges the carriage toward the image-receiving medium.

6. The print head positioner of claim 5, wherein the carriage includes a stop that limits travel of the carriage in the third direction toward the image-receiving medium.

7. The print head positioner of claim 1, further including an interlock to limit carriage travel in the first direction when the carriage is at a home position in the first direction and the carriage is moved a predetermined distance in the third direction away from the image-receiving medium.

8. The print head positioner of claim 7, wherein the interlock comprises a cover plate affixed to the mounting chassis and extending in a plane parallel to the shaft, the cover plate including at least one slot that receives a flange of the carriage when the carriage is moved in the third direction.

9. The print head positioner of claim 8, wherein the cover plate further includes a lip that limits travel of the carriage in the third direction when the carriage is positioned away from the home position in the first direction.

10. The print head positioner of claim 9, wherein the predetermined distance equals approximately five degrees or greater of rotation about the shaft.

11. The print head positioner of claim 10, wherein the first, second and third directions are mutually orthogonal.

12. The print head positioner of claim 11, wherein the image-receiving medium is a drum.

13. The print head positioner of claim 12, wherein the print head is an ink-jet nozzle array type.

14. The print head positioner of claim 13, wherein the printing apparatus is a solid ink color printer.

* * * * *